US005755832A

United States Patent [19]

Toman et al.

[11] Patent Number: 5,755,832

[45] Date of Patent: *May 26, 1998

[54] FUEL ADDITIVE CONCENTRATE CONTAINING TAGGING MATERIAL

[75] Inventors: Jeffrey J. Toman, Oakland; Wilton R. Biggs, Vacaville, both of Calif.

[73] Assignee: Chevron Chemical Company, San Ramon, Calif.

[ * ] Notice: The term of this patent shall not extend beyond the expiration date of Pat. No. 5,512,066.

[21] Appl. No.: 746,028

[22] Filed: Nov. 7, 1996

[51] Int. Cl.[6] ..... C10L 1/22

[52] U.S. Cl. ..... 44/300; 44/389; 44/394; 585/10; 585/11; 585/14

[58] Field of Search ..... 44/300

[56] References Cited

U.S. PATENT DOCUMENTS

| | | | |
|---|---|---|---|
| 2,058,774 | 10/1936 | Colligan | 87/9 |
| 2,265,196 | 12/1941 | Riley | 252/366 |
| 3,438,757 | 4/1969 | Honnen et al. . | |
| 3,682,187 | 8/1972 | Seymour et al. | 137/13 |
| 3,687,148 | 8/1972 | Kruka et al. | 137/13 |
| 3,800,142 | 3/1974 | Harshaw, II | 250/337 |
| 3,861,886 | 1/1975 | Meloy | 44/51 |
| 4,141,692 | 2/1979 | Keller | 44/59 |
| 4,160,648 | 7/1979 | Lewis et al. . | |
| 4,209,302 | 6/1980 | Orelup | 44/59 |
| 4,278,444 | 7/1981 | Beyer et al. | 44/59 |
| 4,735,631 | 4/1988 | Orelup | 44/59 |
| 4,764,474 | 8/1988 | Orelup | 436/111 |
| 4,918,020 | 4/1990 | Nowak | 44/334 |
| 5,205,840 | 4/1993 | Friswell et al. | 44/428 |
| 5,234,475 | 8/1993 | Malhotra et al. | 44/282 |
| 5,252,106 | 10/1993 | Hallisy | 44/328 |
| 5,279,967 | 1/1994 | Bode | 436/56 |
| 5,490,872 | 2/1996 | Friswell et al. | 44/328 |
| 5,498,808 | 3/1996 | Smith | 585/3 |
| 5,512,066 | 4/1996 | Toman et al. | 44/300 |

*Primary Examiner*—Ellen M. McAvoy
*Attorney, Agent, or Firm*—Ernest A. Schaal

[57] ABSTRACT

An additive concentrate has at least one nitrogen-containing deposit control additive, a solvent, and at least one tagging material. The tagging material has a number average molecular weight of at least 15,000 and a weight average to number average molecular weight ratio of less than 1.5. The tagging material has a molecular weight distribution that is sufficiently different from the molecular weight distribution of the deposit control additive so as to be distinguishable from the deposit control additive. The amount of each tagging material is less than 1 weight % of the additive concentrate.

8 Claims, No Drawings

FUEL ADDITIVE CONCENTRATE CONTAINING TAGGING MATERIAL

The present invention relates to fuel additive concentrates having high molecular weight tagging materials therein to permit identification of the gasoline in which the fuel additive concentrates are used.

BACKGROUND OF THE INVENTION

Although the prior art discloses hydrocarbon tagging materials having molecular weights of up to 1,200, that art teaches away from using much higher molecular weight materials as tagging materials.

U.S. Pat. No. 4,141,692 teaches using chlorinated compounds as markers. These dyes have a molecular weight of less than 250.

U.S. Pat. No. 4,209,302 teaches using invisible colored dyes. These dyes have a molecular weight of less than 800.

U.S. Pat. No. 4,278,444 teaches using fluorescent dyes as markers. These dyes have a molecular weight of less than 800.

U.S. Pat. No. 4,735,631 teaches substituted anthraquinone tagging compound, which would have a molecular weight of less than 700.

U.S. Pat. No. 4,764,474 teaches using a substituted anthraquinone tagging compound, which would have a molecular weight of less than 700.

U.S. Pat. No. 4,918,020 teaches a method for analyzing marker dyes by using a solid-phase extraction technique with formation of a colored complex in the extraction column.

U.S. Pat. No. 5,234,475 teaches using one or more fullerene additives as tracers in a fuel. It teaches using up to $C_{84}$ fullerenes, which would have a molecular weight of less than 1100.

European Application 0 509 818 A1 teaches silent markers as tracers in petroleum, such as 2,6-bis(1,1-dimethylethyl)-4-[(4-nitrophenyl)azo-phenol]. The disclosed markers all have molecular weights of less than 900.

SUMMARY OF THE INVENTION

The present invention provides a tagged additive concentrate and a process for identifying hydrocarbon compositions having that tagged additive concentrate.

Our previously filed application, which resulted in U.S. Pat. No. 5,512,066, teaches that gasolines are identified from one another by adding to at least one of the gasolines at least one tagging material which is unique to that gasoline. Each unique tagging material has a number average molecular weight of at least 15,000 and is present at a level of less than 1.0 ppm of the gasoline. A sample of the gasoline is vaporized to form a liquid residue; and the liquid residue is analyzed for the presence of the tagging material in the residue to thereby identify the particular gasoline.

In the present invention, the tagging material is first included in a tagged additive concentrate. The tagged additive concentrate contains at least one nitrogen-containing deposit control additive, a solvent, and a detectable amount of at least one tagging material therein serving as an identification means. Each tagging material has a number average molecular weight of at least 15,000, and is present in the additive concentrate in an amount of less than 1 weight % of the additive concentrate.

Each tagging material must be soluble in gasoline, in the additive concentrate, and in the solvent. Each tagging material must also have a molecular weight distribution that is sufficiently different from the molecular weight distribution of the deposit control additive so as to be distinguishable from that deposit control additive. Each tagging material must not vaporize or thermally degrade at temperatures below about 120° C., must not contribute to degradation of hydrocarbon filterability, and must not contribute to engine harm.

Preferably, the tagging materials have a weight average to number average molecular weight ratio of less than 1.5. Also preferably, the tagging material is a polymer of at least one monomer of an acrylic acid ester or a methacrylic acid ester. More preferably, the monomer has at least eight carbon atoms.

In the process for identifying a hydrocarbon composition that contains a additive concentrate having at least one nitrogen-containing deposit control additive and a solvent, the additive concentrate has added to it at least one tagging material that serves as an identification means. Each tagging material is present in amounts less than 1 weight % of the additive concentrate and less than 1.0 ppm of the hydrocarbon composition. Each tagging material has the properties described above. A sample of the composition is vaporized to form a liquid residue, and the liquid residue is analyzed for the presence of the tagging material to thereby identify the particular hydrocarbon composition.

DETAILED DESCRIPTION OF THE INVENTION

In its broadest aspect, the present invention involves an additive concentrate containing at least one nitrogen-containing deposit control additive, a solvent, and a detectable amount of at least one tagging material therein serving as identification means. Each tagging material used has a number average molecular weight of at least 15,000 and is present in the additive concentrate in an amount of less than 1 weight % of the additive concentrate.

The Nitrogen-Containing Deposit Control Additive

The additive concentrate contains at least one nitrogen-containing deposit control additive.

The nitrogen-containing deposit control additive can be, for example:

(a) Polyisobutyl amines obtained via chlorination of polyisobutene and subsequent reaction with mono- or polyamines, as disclosed in U.S. Pat. No. 3,438,757;

(b) Polyisobutyl amines obtained via hydroformylation of reactive polyisobutene to give polyisobutyl alcohol and subsequent reductive amination with ammonia to polyisobutyl amine;

(c) Poly(oxyalkylene) aminocarbamates obtained via reaction of phosgene with a hydrocarbyl-capped poly (oxyalkylene) compound, followed by reaction of the product with a suitable amine, as disclosed in U.S. Pat. No. 4,160,648;

(d) Reductively aminated poly(oxyalkylene) amines;

(e) Polybutene succinimides obtained via the thermal reaction of polyisobutene and maleic anhydride, followed by reaction of the product with a suitable amine, as disclosed in WO 9,306,194;

(f) Polybutene succinimides obtained via the reaction of polyisobutene and maleic anhydride in which chlorine is used to improve the reactivity of the polyisobutene, followed by reaction of the product with a suitable amine.

It is possible to use deposit control additives similar to the above, but prepared by different processes, or other deposit control additives, in this invention.

Typical concentrations in the additive concentrate for the deposit-control additive range from about 10 weight % to about 60 weight %.

The Solvent

The purpose of the solvent is to solvate the deposit control additive with the tagging material, which is often not miscible with the deposit control additive alone. The solvent also provides better handling properties for the additive concentrate, e.g. a lower viscosity, especially at low temperatures.

The solvent used in the concentrate is an inert oleophilic organic solvent boiling in the range of about 150° F. to 400° F. An aliphatic, or preferably an aromatic, solvent is used, such as benzene, toluene, xylene, or higher boiling aromatics. Aliphatic alcohols of 3 to 10 carbon atoms are also suitable for use in the additive concentrate. The most preferred solvent is an aromatic solvent with flash point of greater than about 100° F.

Typical concentrations in the additive concentrate for the solvent range from about 10 weight % to about 50 weight %.

The Tagging Materials

The tagging materials serve as an identification means. The amount of each tagging material is less than 1 weight % of the additive concentrate. Each tagging material has a number average molecular weight of at least 15,000; must be soluble in gasoline, the additive concentrate, and the solvent; must not vaporize or thermally degrade at temperatures below about 120° C.; must not contribute to degradation of hydrocarbon filterability, and, must not contribute to engine harm.

Preferably, the tagging material has a weight average to number average molecular weight ratio of less than 1.5. One preferred tagging material is a polymer of at least one monomer selected from the group consisting of an acrylic acid ester and a methacrylic acid ester. The tagging material can be a copolymer of those two monomers.

It is important that the concentration of the tagging material be less than 1.0 ppm in the final hydrocarbon composition in order to insure that the presence in the hydrocarbon composition is for tagging purposes. There are a variety of patents, such as U.S. Pat. Nos. 3,682,187 and 3,687,148, that teach the use of high molecular weight block copolymers as drag reducers at concentrations of more than 1 ppm. The presence of a high molecular weight material at a concentrations below that effective for drag reduction insures that the material is present as a tagging material and not as a drag reducer. U.S. Pat. Nos. 3,682,187 and 3,687,148 are hereby incorporated by reference for all purposes.

More than one tagging material can be used in an additive concentrate. For example, one can use combinations of different tagging materials, possibly with differing concentrations or concentration ratios, to identify additive concentrates uniquely. For each tagging material to be detectable, the molecular weight distributions of the tagging materials should not significantly overlap, and each tagging material must have a concentration of less than 1 weight % in the additive concentrate.

Preferably, the tagging material has a weight average to number average molecular weight ratio of less than 1.5, so that its molecular weight distribution can be readily distinguished from that of the hydrocarbon composition that is to be tagged. This narrow molecular weight distribution is especially important where more than one tagging material is used, and in cases of fuels contaminated with high molecular weight material.

The Additive Concentrate

The additive concentrate is a mixture comprising at least one deposit control additive, solvent, and tagging material. The concentrate may in addition include other known fuel additives such as anti-knock agents, lead scavengers, antioxidants, corrosion inhibitors, demulsifiers and the like. The molecular weight distributions of the tagging materials should not significantly overlap with the molecular weight distributions of any non-volatile fuel additives used.

A particularly useful fuel additive is a fuel-soluble carrier oil. Exemplary carrier oils include nonvolatile poly (oxyalkylene)s, other synthetic lubricants, or lubricating mineral oil. Typical concentrations in the additive concentrate for the fuel-soluble carrier oil range from about 10 weight % to about 70 weight %.

The Hydrocarbon Composition

The hydrocarbon composition can be any volatile hydrocarbon composition, but this invention is especially useful for tagging gasoline.

The Process

We have discovered that tagging materials having a number average molecular weight of at least 15,000 are detectable in a volatile hydrocarbon composition at a concentration of less than 1.0 ppm of the hydrocarbon composition if the composition is vaporized to form a liquid residue and the molecular weight distribution of the entire residue is determined. The tagging material appears as a separate peak on the molecular weight distribution.

The present invention uses a size exclusion chromatography technique, coupled with evaporative light scattering, to identify trace amounts of high molecular weight materials that act as tracers.

The process identifies hydrocarbon compositions containing additive concentrates by adding to at least one of the containing additive concentrates at least one tagging material which is used for identification means. Each tagging material is present in the additive concentrate in an amount of less than 1 weight % of the additive concentrate. A sample of the composition is vaporized to form a liquid residue, and the liquid residue is analyzed for the presence of the tagging material in the residue to thereby identify the particular hydrocarbon composition.

By using a material with a number average molecular weight of greater than 15,000, and with a molecular weight distribution that is sufficiently different from the molecular weight distribution of the deposit control additive so as to be distinguishable from the deposit control additive, and by prevaporizing the fuel, one can use a size exclusion chromatography technique, coupled with evaporative light scattering, to resolve tracer peaks at levels of 0.05 ppm, or lower, even in the presence of normal contaminants.

EXAMPLES

The invention will be further illustrated by the following examples, which set forth particularly advantageous method embodiments. While the Examples are provided to illustrate the present invention, they are not intended to limit it.

Table I shows the solubility of various polymers in aromatic solvent and in two types of nitrogen-containing deposit control additives. In each example, the polymer was diluted with aromatic solvent (Aromatic 100 solvent obtained from Exxon Chemical Co.) to an actives concentration of 10 weight %, and the solution was categorized as either soluble (no haze or solids), slightly insoluble (hazy or grainy appearance, but not solids), or insoluble (solids present).

The diluted polymers were then blended with a Fuel Additive Concentrate (A) which is a mixture of poly (oxyalkylene) aminocarbamate and solvent to make a tagged additive concentrate. The concentration of the polymer in the final tagged additive concentrate was less than 1 weight %. The tagged additive concentrate was categorized as either soluble (no haze or solids), slightly insoluble (hazy or grainy appearance, but not solids), or insoluble (solids present).

The diluted polymers were also blended with a Fuel Additive Concentrate (B) which is a mixture of polyisobutyl amine, mineral oil, and solvent to make a tagged additive concentrate. The concentration of the polymer in the final tagged additive concentrate was less than 1 weight %. The tagged additive concentrate was categorized as either soluble, slightly insoluble, or insoluble.

The resulting tagged additive concentrates were then diluted to a tagging material concentration comparable to the concentration of the tagging material in the fuel residues described in U.S. Pat. No. 5,512,066. These diluted solutions were then chromatographed according to the procedure described in U.S. Pat. No. 5,512,066. The retention times of the peaks corresponding to the polymers are shown in the table below. Retention times of below 16.5 minutes would be sufficiently different from the peak retention times of both the poly(oxyalkylene) aminocarbamate and polyisobutyl amine to be distinguishable from the deposit control additive peaks. Retention times of below 17.5 minutes would be sufficiently different from the peak retention time of the poly(oxyalkylene) aminocarbamate to be distinguishable from the deposit control additive peak if poly(oxyalkylene) aminocarbamate is used.

Table I

| Polymer | Solubility in Concentrate A | Solubility in Concentrate B | GPC Retention Time, minutes |
|---|---|---|---|
| Poly(butyl acrylate) | Soluble | Slightly insoluble | 16.1 |
| Poly(butyl methacrylate-co-isobutyl methacrylate) | Soluble | Insoluble | 14.1 |
| Poly(2-ethyl hexyl acrylate) | Soluble | Soluble | 17.3 |
| Poly(vinyl stearate) | Soluble | Slightly insoluble | 16.55 |
| Poly(2-ethyl hexyl methacrylate) | Soluble | Soluble | 15.4 |
| Poly(butyl methacrylate) | Soluble | Insoluble | 14.3 |

While the present invention has been described with reference to specific embodiments, this application is intended to cover those various changes and substitutions that may be made by those skilled in the art without departing from the spirit and scope of the appended claims.

What is claimed is:

1. An additive concentrate comprising:

(a) at least one nitrogen-containing deposit control additive, (b) a solvent, and;

(c) at least one tagging material serving as an identification means, wherein the amount of each tagging material is less than 1 weight % of the additive concentrate, and wherein each tagging material has the following properties:

(1) a number average molecular weight of at least 15,000, (2) a molecular weight distribution that is sufficiently different from the molecular weight distribution of the deposit control additive so as to be distinguishable from the deposit control additive, (3) is soluble in gasoline, (4) is soluble in said additive concentrate and in said solvent, (5) does not vaporize or thermally degrade at temperatures below about 120° C., (6) does not contribute to degradation of hydrocarbon filterability, and, (7) does not contribute to engine harm.

2. An additive concentrate according to claim 1 wherein the tagging material has a weight average to number average molecular weight ratio of less than 1.5.

3. An additive concentrate according to claim 1 wherein the tagging material is a polymer of at least one monomer selected from the group consisting of an acrylic acid ester and a methacrylic acid ester.

4. An additive concentrate according to claim 3 wherein the monomer has at least eight carbon atoms.

5. A process for identifying a hydrocarbon composition that contains an additive concentrate having at least one nitrogen-containing deposit control additive and a solvent, said process comprising:

(a) adding to said additive concentrate at least one tagging material serving as an identification means, wherein the amount of each tagging material is less than 1 weight % of the additive concentrate, and wherein each tagging material has the following properties:

(1) a number average molecular weight of at least 15,000, (2) a molecular weight distribution that is sufficiently different from the molecular weight distribution of the deposit control additive so as to be distinguishable from the deposit control additive, (3) is soluble in gasoline, (4) is soluble in said additive concentrate and in said solvent, (5) does not vaporize or thermally degrade at temperatures below about 120° C., (6) does not contribute to degradation of hydrocarbon filterability, and, (7) does not contribute to engine harm;

(b) vaporizing a sample of the composition to form a liquid residue; and (c) analyzing the liquid residue for the presence of the tagging material in the residue to thereby identify the particular hydrocarbon composition.

6. A process according to claim 5 wherein the tagging material has a weight average to number average molecular weight ratio of less than 1.5.

7. A process according to claim 5 wherein the tagging material is a polymer of at least one monomer selected from the group consisting of an acrylic acid ester and a methacrylic acid ester.

8. A process according to claim 7 wherein the monomer has at least eight carbon atoms.

* * * * *